US011559124B2

(12) United States Patent
Kibe et al.

(10) Patent No.: US 11,559,124 B2
(45) Date of Patent: Jan. 24, 2023

(54) HAIR HOLDING TOOL AND METHOD FOR MANUFACTURING SAME

(71) Applicant: KAO CORPORATION, Tokyo (JP)

(72) Inventors: Yoshiyuki Kibe, Utsunomiya (JP); Takehiko Tojo, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 229 days.

(21) Appl. No.: 16/772,611

(22) PCT Filed: Nov. 12, 2018

(86) PCT No.: PCT/JP2018/041879

§ 371 (c)(1),
(2) Date: Jun. 12, 2020

(87) PCT Pub. No.: WO2019/116805

PCT Pub. Date: Jun. 20, 2019

(65) Prior Publication Data

US 2020/0390215 A1 Dec. 17, 2020

(30) Foreign Application Priority Data

Dec. 14, 2017 (JP) ..... JP2017-240018

(51) Int. Cl.
*A45D 7/00* (2006.01)
*A45D 2/18* (2006.01)
*A45D 8/36* (2006.01)

(52) U.S. Cl.
CPC ..... *A45D 8/36* (2013.01); *A45D 2/18* (2013.01)

(58) Field of Classification Search
CPC ..... A45D 2/18; A45D 2/20; A45D 2/2442; A45D 2/245; A45D 19/018; A45D 19/024; A45D 19/012
See application file for complete search history.

(56) References Cited

U.S. PATENT DOCUMENTS 3,255,765 A 6/1966 Sturdivant
3,692,032 A * 9/1972 Regas ..... A45D 19/018 132/270

(Continued)

FOREIGN PATENT DOCUMENTS

CN 85108318 A 8/1986
CN 1346241 A 4/2002

(Continued)

OTHER PUBLICATIONS

International Search Report for PCT/JP2018/041879 dated Feb. 5, 2019.

*Primary Examiner* — Rachel R Steitz
(74) *Attorney, Agent, or Firm* — Xsensus LLP

(57) ABSTRACT

A hair holder (1) includes a tubular body (2) that is constituted by a sheet and through which a bundle of hair can be inserted from an opening (21) at a one end toward an opening (22) at the other end, and has a flat shape. The tubular body (2) includes a first surface sheet (23A) and a second surface sheet (23B) that are located on the inside and the outside, respectively, in a state in which the hair holder (1) is rolled up. Side regions of the first surface sheet (23A) and side regions of the second surface sheet (23B) are joined to each other, thereby forming a pair of side joined regions (24) in the tubular body (2). The side joined regions (24) have a plurality of second-surface-sheet-side recesses (25) along a longitudinal direction (X) of the side joined regions (24), the recesses being recessed from the second surface sheet (23B) side toward the first surface sheet (23A) side.

20 Claims, 4 Drawing Sheets

(56) References Cited

U.S. PATENT DOCUMENTS

| | | | | |
|---|---|---|---|---|
| 6,394,101 | B1 * | 5/2002 | Secreto | A45D 2/20 132/262 |
| 8,132,576 | B1 * | 3/2012 | Trottier | A45D 19/012 132/270 |
| 2006/0157078 | A1 | 7/2006 | Tojo et al. | |
| 2008/0257370 | A1 * | 10/2008 | Perry | A61Q 5/065 132/270 |
| 2008/0302381 | A1 * | 12/2008 | Tojo | A45D 2/18 132/222 |

FOREIGN PATENT DOCUMENTS

| | | | |
|---|---|---|---|
| CN | 200969955 | Y | 11/2007 |
| CN | 102048340 | A | 5/2011 |
| CN | 106510166 | A | 3/2017 |
| EP | 1 704 791 | A1 | 9/2006 |
| JP | 2006-68368 | A | 3/2006 |
| JP | 2006129972 | A | 5/2006 |
| JP | 2007-130199 | A | 5/2007 |
| TW | M413387 | U1 | 10/2011 |
| TW | M446537 | U1 | 2/2013 |

* cited by examiner

HAIR HOLDING TOOL AND METHOD FOR MANUFACTURING SAME

TECHNICAL FIELD

The present invention relates to a hair holder and a method for manufacturing the hair holder.

BACKGROUND ART

A hair holder including a flat tubular body that is constituted by a sheet and through which a bundle of hair can be inserted from an opening at one end toward an opening at the other end is known (see Patent Literature 1, for example). Patent Literature 1 states that, with the hair holder disclosed therein, the operation for winding a bundle of hair can be easily performed.

Also, the applicant of the present invention has previously proposed a technique of forming recesses in a hair holder constituted by a flat tubular body by heat embossing the hair holder, to thereby reduce the amount of water absorption in the recesses (Patent Literature 2).

CITATION LIST

Patent Literatures

Patent Literature 1: U.S. Pat. No. 3,255,765
Patent Literature 2: JP 2007-130199A

SUMMARY OF INVENTION

The present invention provides a hair holder comprising a tubular body and having a flat shape, wherein the tubular body comprises a sheet, and has a first opening located at one end of the tubular body and a second opening located at the other end of the tubular body, and is configured to allow a bundle of hair to be inserted from the first opening toward the second opening.

The tubular body includes a first surface sheet and a second surface sheet that are located on the inside and the outside, respectively, in a state in which the tubular body of the hair holder is rolled up.

Side regions of the first surface sheet and side regions of the second surface sheet are joined to each other to form the sheet, thereby forming a pair of side joined regions in the tubular body.

At least one of the side joined regions has a plurality of second-surface-sheet-side recesses along a longitudinal direction of the side joined region, and the second-surface-sheet-side recess is recessed from the second surface sheet side toward the first surface sheet side.

The present invention also provides a preferred method for manufacturing the hair holder.

In a state in which a first surface sheet and a second surface sheet oppose each other, side regions of the first surface sheet and side regions of the second surface sheet are joined to each other, thereby forming a tubular body having a pair of side joined regions and, at the same time, forming a plurality of second-surface-sheet-side recesses in the side joined regions along a longitudinal direction of the side joined regions, the second-surface-sheet-side recesses being recessed from the second surface sheet side toward the first surface sheet side.

DESCRIPTION OF EMBODIMENTS

Many previously known hair holders are composed of a fiber sheet or a film made of a thermoplastic resin, and are formed into a tubular body by fusion bonding both side regions of two sheets opposing each other. The side regions formed through fusion bonding are film-like, and due to this, the side regions may be slippery when held with a hand. In particular, the side regions may be even more slippery when a hair treatment agent such as a permanent wave agent is used. Moreover, due to the side regions becoming film-like, the side regions are hard and difficult to deform, and consequently, it may be difficult to roll up the hair holder. Thus, there is a room for improvement in conventionally known hair holders in terms of the ease of operation.

Therefore, the present invention relates to a hair holder having ease of operation and a method for manufacturing the hair holder.

Figure 1:
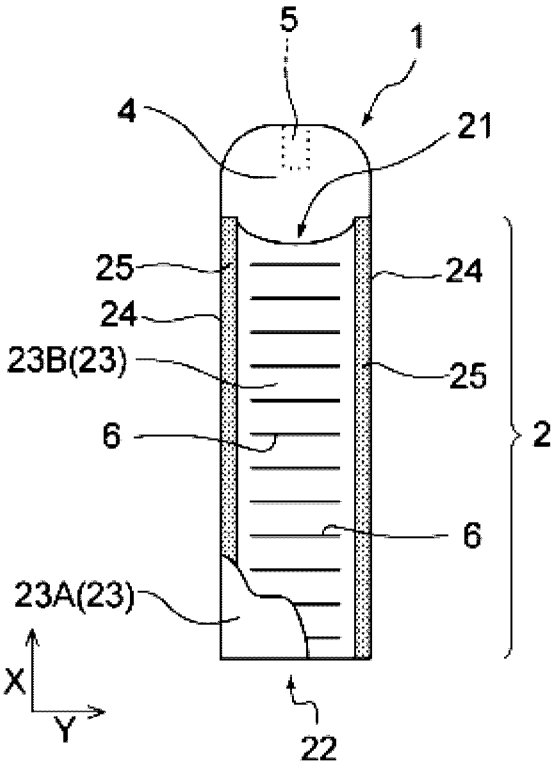
FIG. 1 is a partially cutaway front view showing an embodiment of a hair holder of the present invention.

Hereinafter, the present invention will be described based on preferred embodiments thereof with reference to the drawings. FIG. 1 shows an embodiment of the hair holder of the present invention. A hair holder 1 shown in FIG. 1 includes a tubular body 2 that is constituted by sheets 23A and 23B and through which a bundle of hair (not shown) can be inserted from an opening 21 at one end toward an opening 22 at the other end. A longitudinal direction X of the hair holder 1 extends in the up-down direction in the paper plane of FIG. 1, and a width direction Y of the hair holder 1 is orthogonal to the longitudinal direction X. The hair holder 1 has a flat shape that extends in a plane defined by the longitudinal direction X and the width direction Y.

The tubular body 2 constituting the hair holder 1 includes a first surface sheet 23A and a second surface sheet 23B that are located on the inside and the outside, respectively, when the hair holder 1 is rolled up. The first surface sheet 23A and the second surface sheet 23B have the same shape and the same size, and their shape is a rectangle that is oblong in the longitudinal direction X. In a state in which the first surface sheet 23A and the second surface sheet 23B oppose each other, side regions of the first surface sheet 23A and side regions of the second surface sheet 23B are joined to each other. Thus, a pair of side joined regions 24 are formed in the tubular body 2. The side joined regions 24 are formed extending over the entire length of a region where the first surface sheet 23A and the second surface sheet 23B oppose each other. The sheets 23A and 23B are bonded to each other in this manner, so that a bundle of hair can be inserted between the sheets 23A and 23B along the longitudinal direction X of the tubular body 2. The tubular body 2 has a uniform width over the entire length thereof.

Hereinafter, to provide a description that applies to both the first surface sheet 23A and the second surface sheet 23B, the two sheets will be collectively expressed as a "base material sheet 23". The base material sheet 23 may be formed from a material such as, for example, a nonwoven fabric (a polyethylene nonwoven fabric, a polyethylene terephthalate nonwoven fabric, or the like), a woven fabric, a net-like sheet, a porous or nonporous resin film (a polyethylene film, a polyethylene terephthalate film, or the like), paper, a macromolecular material sheet, a rubber sheet, or a composite or the like of these.

Figure 2:
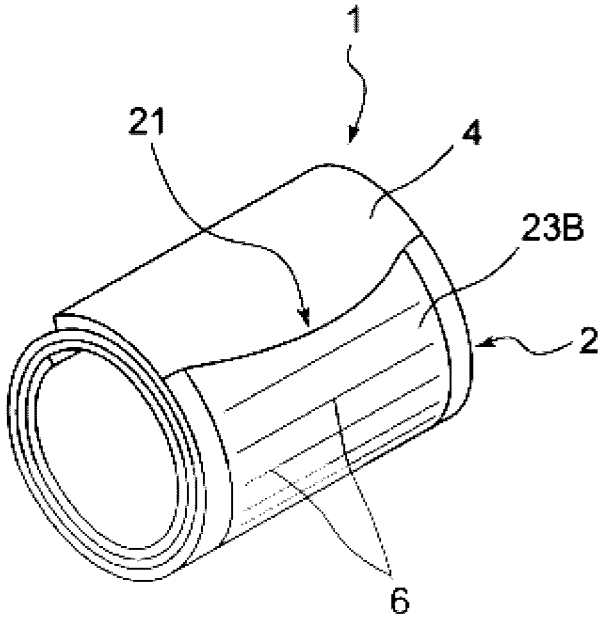
FIG. 2 is a cross-sectional view showing a wound body of the hair holder shown in FIG. 1.

The hair holder 1 is configured to be capable of being rolled up. Being configured to be capable of being rolled up means that the hair holder 1 can be wound into a roll shape as shown in FIG. 2. Such a configuration may be a configuration in which the hair holder 1 automatically rolls up or may be a configuration in which the hair holder 1 is manually rolled up. From the standpoint of facilitating winding of the hair holder 1 even more, it is preferable that the hair holder 1 has the automatic rolling-up configuration. An example of the automatic rolling-up configuration is a configuration in which the hair holder 1 is wound in a roll shape in its natural state, and upon releasing the hand from the hair holder 1 after stretching out the hair holder 1 and inserting a bundle of hair therein, the hair holder 1 rolls up together with the bundle of hair. Such a configuration can be achieved by either or both of the first surface sheet 23A and the second surface sheet 23B being made of a shape memory sheet. The shape memory sheet can be formed by bonding together films having different heat shrinkage rates or films having different tensions, for example. Moreover, the hair holder 1 may also return to its memorized original roll shape when the base material sheet 23 constituting the tubular body 2 is heated.

The base material sheet 23 of the hair holder 1 may also have a slit. For example, as shown in FIGS. 1 and 2, the second surface sheet 23B of the hair holder 1 can be provided with a plurality of slits 6 that is laterally-elongated extending in the width direction Y and spaced apart from each other in the longitudinal direction X. For example, the slits 6 can be provided over the entire region of the second surface sheet 23B with respect to the longitudinal direction X. When the slits 6 are provided, the extensibility of the base material sheet 23 constituting the hair holder 1 can be improved, and the hair holder 1 can be smoothly rolled up. In particular, it is advantageous if the second surface sheet 23B, which is located on the outside when rolled up, is provided with the slits 6 that are spaced apart from each other in the longitudinal direction X, because the hair holder 1 can then be even more smoothly rolled up. Thus, it is preferable that a plurality of slits 6 each having a shape elongated in the width direction Y of the hair holder 1 are formed in the base material sheet 23, which constitutes the hair holder 1, while being spaced apart from each other in the longitudinal direction X of the hair holder 1. It is more preferable that a plurality of slits 6 is formed in both the first surface sheet 23A and the second surface sheet 23B, which constitute the hair holder 1.

Instead of the slits 6 shown in FIGS. 1 and 2, slits disclosed in FIG. 1 etc. of JP 2006-129972A, for example, can also be provided in the base material sheet 23.

As shown in FIG. 1, an extended portion 4 extending from the first surface sheet 23A along the longitudinal direction X of the tubular body 2 is provided near an end portion of the opening 21 at one end of the tubular body 2 of the hair holder 1. The first surface sheet 23A and the extended portion 4 are integrally formed. A roll fixing portion 5 is provided on a side of the extended portion 4 that is opposite to the second surface sheet 23B. The roll fixing portion 5 is engageable with the second surface sheet 23B. The roll fixing portion 5 keeps the tubular body 2 in a rolled-up state by engaging with the tubular body 2 in the rolled-up state. Various members can be used as the roll fixing portion 5 as long as they are engageable with the second surface sheet 23B. In the present embodiment, a male member of a mechanical fastener is used.

The tubular body 2 of the hair holder 1 may be stretched in the natural state; however, when considering the ease of use, it is preferable that the tubular body 2, in the natural state, is wound into a roll shape with the first surface sheet 23A located on the inside (see FIG. 2).

The side joined regions 24 of the tubular body 2 are formed by joining the first surface sheet 23A and the second surface sheet 23B to each other as described above. At least one side joined region 24 of the pair of side joined regions 24 has a plurality of second-surface-sheet-side recesses 25 along the longitudinal direction X of the side joined region 24, the second-surface-sheet-side recesses 25 being recessed from the second surface sheet 23B side toward the first surface sheet 23A side and arranged. FIG. 1 shows a state in which second-surface-sheet-side recesses 25 are arranged regularly in a scattered dot pattern over the entire region of each of the two side joined regions 24. Accordingly, the second-surface-sheet-side recesses 25 are formed discontinuously in both the longitudinal direction X and the width direction Y of the side joined regions 24.

The second surface sheet 23B faces the outer side in a state in which the hair holder 1 is wound. Thus, in a wound body of the hair holder 1, the second-surface-sheet-side recesses 25 are in a state of being recessed in the radial direction of the wound body toward the center thereof. When such second-surface-sheet-side recesses 25 are formed, even in the case where a hair treatment agent such as a permanent wave agent is used after a bundle of hair is inserted into the hair holder 1, a frictional force or a locking force caused by the second-surface-sheet-side recesses 25 makes the hair holder 1 unlikely to slip when the hair holder 1 is held. Moreover, because the second-surface-sheet-side recesses 25 are formed, the hair holder 1 easily bends along the width direction Y, and as a result, the operation for rolling up the hair holder 1 is also easy.

In order to make the above-described effects, which are achieved by forming the second-surface-sheet-side recesses 25, even more profound, the percentage of the sum total of the areas of the second-surface-sheet-side recesses 25 in the area of the side joined region 24 is preferably 5% or greater, more preferably 10% or greater, and even more preferably 20% or greater. Also, this percentage is preferably 70% or less, more preferably 60% or less, and even more preferably 55% or less. The percentage of the sum total of the areas of the second-surface-sheet-side recesses 25 in the area of the side joined region 24 is preferably from 5% to 70%, more preferably from 10% to 60%, and even more preferably from 20% to 55%.

When focusing on the individual second-surface-sheet-side recesses 25, the width, that is, the length in the width direction Y of a second-surface-sheet-side recess 25 is preferably 0.5 mm or greater, more preferably 0.8 mm or greater, and even more preferably 1 mm or greater. Also, the width of a second-surface-sheet-side recess 25 is preferably 5 mm or less, more preferably 4 mm or less, and even more preferably 3 mm or less. Specifically, the width of a second-surface-sheet-side recess 25 is preferably from 0.5 to 5 mm, more preferably from 0.8 to 4 mm, and even more preferably from 1 to 3 mm.

In relation to the width of the second-surface-sheet-side recesses 25, the area of each individual second-surface-sheet-side recess 25 is preferably 0.19 $mm^2$ or greater, more preferably 0.50 $mm^2$ or greater, and even more preferably 0.78 $mm^2$ or greater. Also, the area of each individual second-surface-sheet-side recess 25 is preferably 25 $mm^2$ or less, more preferably 16 $mm^2$ or less, and even more preferably 9 $mm^2$ or less. Specifically, the area of each individual second-surface-sheet-side recess 25 is preferably from 0.19 to 25 $mm^2$, more preferably from 0.50 to 16 $mm^2$, and even more preferably from 0.78 to 9 $mm^2$.

In order to form the second-surface-sheet-side recesses 25, for example, the following process can be adopted: the first surface sheet 23A and the second surface sheet 23B are arranged between a joining block (not shown) and an anvil (not shown) while opposing each other, and side regions of the first surface sheet 23A and side regions of the second surface sheet 23B are joined to each other, thereby forming a tubular body that has a pair of side joined regions 24 and, at the same time, forming second-surface-sheet-side recesses 25 in the side joined regions 24. In this case, it is preferable that the joining block faces the second surface sheet 23B, and the anvil faces the first surface sheet 23A. It is preferable that the joining block has protrusions on a surface thereof that faces the second surface sheet 23B, the protrusions having a shape that is complementary to the shape of the second-surface-sheet-side recesses 25. The joining block is for example capable of heating, so that the side joined regions 24 and the second-surface-sheet-side recesses 25 can be formed through fusion bonding. Alternatively, the joining block is for example capable of ultrasonically vibrating, so that the side joined regions 24 and the second-surface-sheet-side recesses 25 can be formed through fusion bonding by means of frictional heat generated by ultrasonic vibrations.

Although FIG. 1 shows a state in which second-surface-sheet-side recesses 25 are formed over the entire region of each of the side joined regions 24, the positions at which the second-surface-sheet-side recesses 25 are formed are not limited to this. For example, if second-surface-sheet-side recesses 25 are formed in a region of a side joined region 24 that includes the opening 22 at the other end and occupies ⅓ or greater, or in particular, ½ or greater of the entire length of the side joined region 24, the hair holder 1 is unlikely to slip during the rolling-up operation.

Figure 3A:
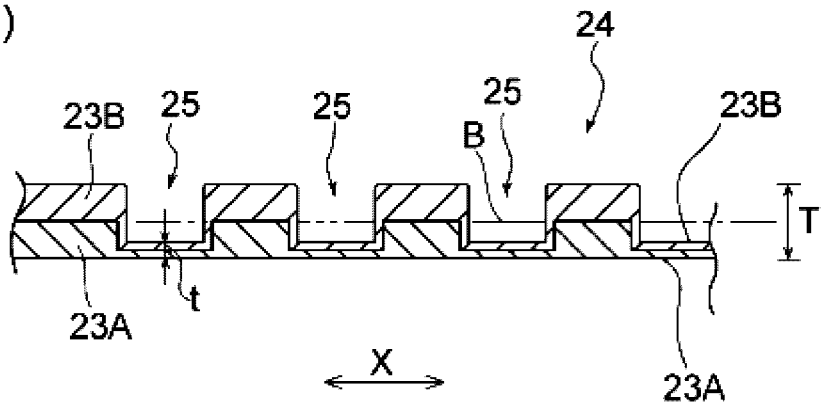
FIGS. 3(*a*) and 3(*b*) are cross-sectional views showing structures of a side joined region of the hair holder shown in FIG. 1.
Figure 3B:
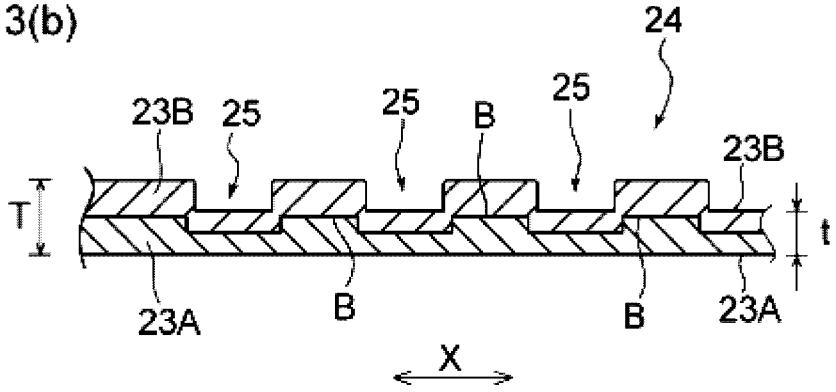

FIGS. 3(*a*) and 3(*b*) show cross-sectional views for the thickness direction of a side joined region 24 of the hair holder 1 taken along the longitudinal direction. With respect to second-surface-sheet-side recesses 25 formed in the side joined region 24, bottom portions of the second-surface-sheet-side recesses 25 are formed by the second surface sheet 23B, and the second surface sheet 23B forming the bottom portions is situated on the first surface sheet 23A side beyond a boundary B between the second surface sheet 23B and the first surface sheet 23A as shown in FIG. 3(*a*), or is not situated on the first surface sheet 23A side beyond the boundary B as shown in FIG. 3(*b*). As shown in FIGS. 3(*a*) and 3(*b*), the boundary B refers to a position at which the first surface sheet 23A and the second surface sheet 23B face each other, in a section of the hair holder 1 where the first surface sheet 23A and the second surface sheet 23B are not joined to each other and no recess where the two sheets 23A and 23B are recessed is present. Out of the embodiments shown in FIGS. 3(*a*) and 3(*b*), if the embodiment shown in FIG. 3(*a*) is adopted, even when the rolling-up operation of the hair holder 1 is performed a plurality of times, separation of the first surface sheet 23A and the second surface sheet 23B in the side joined region 24 is unlikely to occur, and the durability of the side joined region 24 is improved. In order to make this effect even more profound, it is preferable that, in each second-surface-sheet-side recess 25, a region that occupies preferably 10% or greater, more preferably 30% or greater, even more preferably 50% or greater, and yet more preferably 100% of the thickness of the second surface sheet 23B constituting the bottom portion of the second-surface-sheet-side recess 25 is situated on the first surface sheet 23A side beyond the boundary B between the second surface sheet 23B and the first surface sheet 23A. Specifically, a region that occupies preferably from 10% to 100%, more preferably from 30% to 100%, even more preferably from 50% to 100%, and yet more preferably 100% of the thickness of the second surface sheet 23B constituting the bottom portion is situated on the first surface sheet 23A side beyond the boundary B between the second surface sheet 23B and the first surface sheet 23A.

Figure 4:
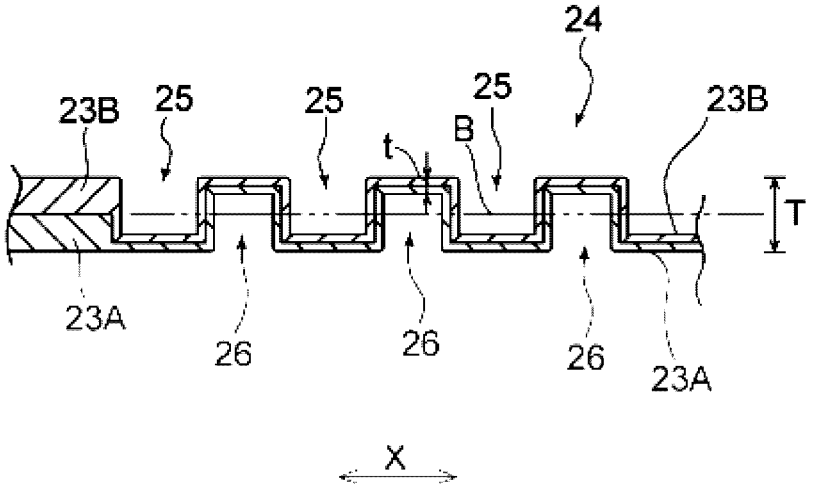
FIG. 4 is a cross-sectional view showing another structure of the side joined region of the hair holder shown in FIG. 1.

As shown in FIG. 4, in the side joined region 24, it is preferable that, in addition to the second-surface-sheet-side recesses 25, a first-surface-sheet-side recess 26 is also formed. The first-surface-sheet-side recess 26 is formed by the side joined region 24 being recessed from the first surface sheet 23A side toward the second surface sheet 23B side. A plurality of first-surface-sheet-side recesses 26 is formed along the longitudinal direction X of the side joined region 24. The configuration in which the second-surface-sheet-side recesses 25 and the first-surface-sheet-side recesses 26 are formed in the side joined region 24 has the following advantage: in a wound body of the hair holder 1 that is rolled up, between layers of the side joined region 24 that overlap in the radial direction of the wound body, a second-surface-sheet-side recess 25 and a first-surface-sheet-side recess 26 are caught on each other or bite into (engage with) each other, and thus, the catch resistance increases.

It is preferable that the first-surface-sheet-side recesses 26 generally have a shape that is complementary to the shape of the second-surface-sheet-side recesses 25. Accordingly, the percentage of the sum total of the areas of the first-surface-sheet-side recesses 26 in the area of the side joined region 24, as well as the width, area, and the like of the first-surface-sheet-side recesses 26 can be similar to those of the second-surface-sheet-side recesses 25. However, the first-surface-sheet-side recesses 26 are not restricted from having a different shape or a different size than those of the second-surface-sheet-side recesses 25.

As a result of the second-surface-sheet-side recesses 25 and the first-surface-sheet-side recesses 26 being formed in the side joined region 24, an apparent thickness T (see FIGS. 3(*a*), 3(*b*), and 4) of the side joined region 24 is greater than a thickness t (see FIGS. 3(*a*), 3(*b*), and 4), which is the real thickness thereof. For example, in order to make the above-described effect achieved by forming both the second-surface-sheet-side recesses 25 and the first-surface-sheet-side recesses 26 even more profound, the value of T/t is preferably 1.01 or greater, more preferably 1.1 or greater, and even more preferably 1.5 or greater. Also, the value of T/t is preferably 20 or less, more preferably 10 or less, and even more preferably 5 or less. Specifically, the value of T/t is preferably from 1.01 to 20, more preferably from 1.1 to 10, and even more preferably from 1.5 to 5.

The value of the apparent thickness T itself of the side joined region 24 is preferably 0.10 mm or greater, more preferably 0.20 mm or greater, and even more preferably 0.25 mm or greater. Also, the value of T is preferably 2.00 mm or less, more preferably 1.50 mm or less, and even more preferably 1.00 mm or less. Specifically, the value of T is preferably from 0.10 to 2.00 mm, more preferably from 0.20 to 1.50 mm, and even more preferably from 0.25 to 1.00 mm.

FIG. 4 shows a state in which the second surface sheet 23B is situated on the first surface sheet 23A side beyond the boundary B between the second surface sheet 23B and the first surface sheet 23A. On the other hand, the same applies to the first-surface-sheet-side recesses 26, and it is preferable that the first surface sheet 23A constituting bottom portions of the first-surface-sheet-side recesses 26 is situated on the second surface sheet 23B side beyond the boundary B between the first surface sheet 23A and the second surface sheet 23B shown in FIG. 4. In particular, in each first-surface-sheet-side recess 26, it is preferable that a region that occupies preferably 10% or greater, more preferably 30% or greater, even more preferably 50% or greater, and yet more preferably 100% of the thickness of the first surface sheet 23A constituting the bottom portion of the first-surface-sheet-side recess 26 is situated on the second surface sheet 23B side beyond the boundary B between the first surface sheet 23A and the second surface sheet 23B. Specifically, a region that occupies preferably from 10% to 100%, more preferably from 30% to 100%, even more preferably from 50% to 100%, and yet more preferably 100% of the thickness of the first surface sheet 23A constituting the bottom portion is situated on the second surface sheet 23B side beyond the boundary B between the first surface sheet 23A and the second surface sheet 23B.

Figure 5:
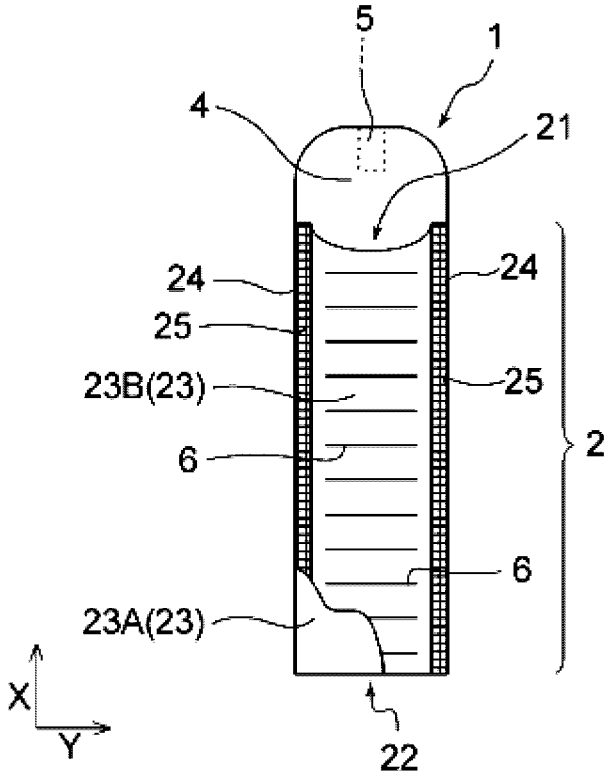
FIG. 5 is a partially cutaway front view showing another embodiment of the hair holder of the present invention.

FIG. 5 shows another embodiment of the present invention. A hair holder 1 shown in FIG. 5 differs from the embodiment shown in FIG. 1 in terms of the shape of the second-surface-sheet-side recesses 25 formed in the side joined region 24. In the present embodiment, the second-surface-sheet-side recesses 25 continuously extend along the longitudinal direction X of the side joined region 24 and continuously extend along the width direction Y of the side joined region 24. The second-surface-sheet-side recesses 25 extend over the entire longitudinal direction of the side joined region 24 and extend over the entire width direction of the side joined region 24. When the second-surface-sheet-side recesses 25 are formed in such shapes, even in the case where a hair treatment agent such as a permanent wave agent is used after a bundle of hair is inserted into the hair holder 1, the hair treatment agent is guided by the second-surface-sheet-side recesses 25 extending along the width direction Y and easily discharged to the outside, and therefore, the hair holder 1 is unlikely to slip when the hair holder 1 is held. Moreover, the second-surface-sheet-side recesses 25 extending along the width direction Y make the hair holder 1 easier to bend along the width direction Y, and as a result, the rolling-up operation of the hair holder 1 can be performed even more easily. Furthermore, due to the second-surface-sheet-side recesses 25 extending continuously, even when the rolling-up operation of the hair holder 1 is performed a plurality of times, separation of the first surface sheet 23A and the second surface sheet 23B in the side joined region 24 is unlikely to occur, and the durability of the side joined region 24 is improved. In addition to that, when the hair holder 1 is rolled up into a wound body, the diameter of the wound body is unlikely to change. Note that these effects are also achieved in the case of an embodiment in which second-surface-sheet-side recesses 25 extend continuously only along the width direction Y of the side joined region 24.

Figure 6:
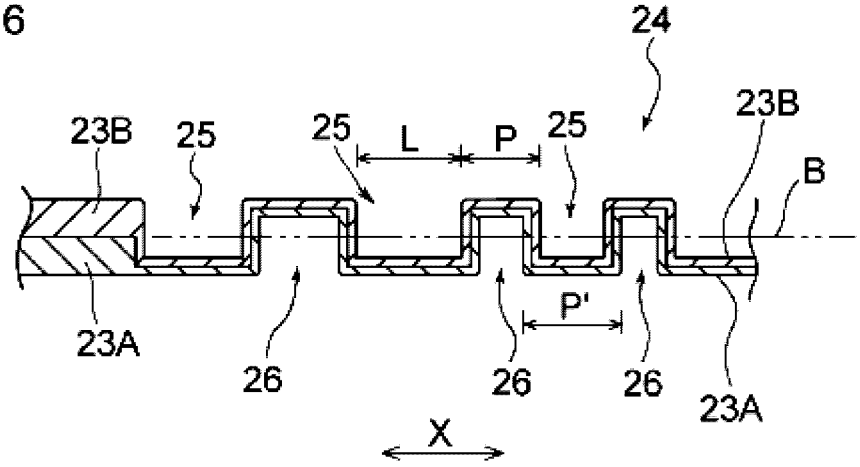
FIG. 6 is a cross-sectional view showing another structure of a side joined region of the hair holder of the present invention.

FIG. 6 shows yet another embodiment of the hair holder of the present invention. FIG. 6 shows a cross-sectional structure of a side joined region 24 of a hair holder 1. In the present embodiment, the distance P between adjacent second-surface-sheet-side recesses 25 and 25 along the longitudinal direction X of the side joined region 24 gradually increases from the opening 22 at the other end toward the opening 21 at the one end. With this configuration, in a wound body into which the hair holder 1 is rolled up, between layers of the side joined region 24 that overlap each other in the radial direction of the wound body are more likely to be caught on each other. As a result, the wound state is kept even more reliably. In order to make this effect even more profound, when the distance P1 between certain second-surface-sheet-side recesses 25 is taken as a reference, the distance P2 between other second-surface-sheet-side recesses 25 located at a position that is shifted toward the opening 21 at the one end by a length of $\pi D$ (D represents the diameter of the hair holder 1 in the wound state at a position where the distance P1 between the certain second-surface-sheet-side recesses 25 is present) is preferably not less than 1.05 times, and more preferably not less than 1.1 times P1. Also, P2 is preferably not more than 5 times, and more preferably not more than 3 times P1. Specifically, P2 is preferably from 1.05 to 5 times, and more preferably from 1.1 to 3 times P1. Moreover, it is also preferable that the side joined region 24 also includes first-surface-sheet-side recesses 26, and the distance P' between adjacent first-surface-sheet-side recesses 26 and 26 along the longitudinal direction X of the side joined region 24 gradually increases from the opening 22 at the other end toward the opening 21 at the one end.

Note that, in the embodiment shown in FIG. 6, in addition to the distance P between adjacent second-surface-sheet-side recesses 25 and 25 along the longitudinal direction X of the side joined region 24 gradually increasing from the opening 22 at the other end toward the opening 21 at the one end, the length L of the second-surface-sheet-side recesses 25 in the longitudinal direction X gradually increases from the opening 22 at the other end toward the opening 21 at the one end. Alternatively, it is also possible that only the distance P between the second-surface-sheet-side recesses 25 and 25 gradually increases from the opening 22 at the other end toward the opening 21 at the one end, and the length L of the second-surface-sheet-side recesses 25 in the longitudinal direction X is uniform at any position in the longitudinal direction X.

Figure 7:
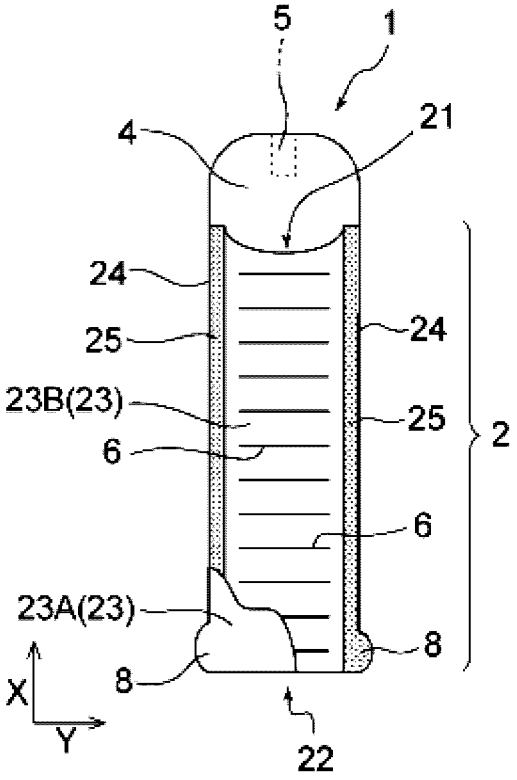
FIG. 7 is a partially cutaway front view showing another embodiment of the hair holder of the present invention.

FIG. 7 shows yet another embodiment of the hair holder of the present invention. A hair holder 1 shown in FIG. 7 has winding and tightening tabs 8 near the opening 22 at the other end of the respective side joined regions 24, the winding and tightening tabs 8 extending outward in the width direction Y. The winding and tightening tabs 8 are integrally formed with the first surface sheet 23A so as to be located near the opening 22 at the other end of the first surface sheet 23A and extend outward in the width direction Y. With this configuration, when winding the hair holder 1 with a bundle of hair inserted therein, it is possible to roll up the hair holder 1 easily, and tightly, if necessary, by rolling up the hair holder 1 while holding the winding and tightening tabs 8 with hands. Instead of the winding and tightening tabs 8 shown in FIG. 7, winding and tightening tabs disclosed in paragraph [0019] of JP 2006-129972A, for example, can also be provided as the winding and tightening tabs 8. The formation method, shape, size, thickness, arrangement, and the like of the winding and tightening tabs 8 can be set as appropriate.

Note that descriptions of FIGS. 1 to 4 appropriately apply to those points that are not expressly described in the embodiments shown in FIGS. 5 to 7. Moreover, in FIGS. 5 to 7, the same members as those in FIGS. 1 to 4 are denoted by the same reference numerals.

Although the present invention has been described above based on the preferred embodiments thereof, the present invention is not limited to the foregoing embodiments. For example, the shape of the second-surface-sheet-side recesses 25 formed in the side joined region 24 is not limited to those described above, and may be other shapes. For example, the second-surface-sheet-side recesses 25 may have shapes continuously extending only along the width direction Y of the side joined region 24 or shapes continuously extending only along the longitudinal direction X of the side joined region 24. Furthermore, the second-surface-sheet-side recesses 25 may also be formed in a diagonal lattice-like pattern.

Moreover, in the foregoing embodiments, the side joined region 24 may be provided with a reinforcement to thereby improve the durability of the side joined region 24. As the reinforcement, for example, a sheet strip having substantially the same width as the side joined region 24 can be arranged between the first surface sheet 23A and the second surface sheet 23B, on the surface of the first surface sheet 23A, or on the surface of the second surface sheet 23B. The reinforcement can be composed of a similar material to that of the first surface sheet 23A or the second surface sheet 23B, for example.

Those portions of each of the foregoing embodiments that have not been described as well as requirements for only one of the embodiments can individually be applied to other embodiments as appropriate. Moreover, requirements for various embodiments can be interchanged with one another among the embodiments as appropriate.

Related to the above-mentioned embodiment, the present invention further discloses the following hair holder and method for manufacturing the same.

<1> A hair holder comprising a tubular body and having a flat shape, wherein the tubular body comprises a sheet, and has a first opening located at one end of the tubular body and a second opening located at the other end of the tubular body, and is configured to allow a bundle of hair to be inserted from the first opening toward the second opening, and the tubular body comprises a first surface sheet and a second surface sheet that are located on the inside and the outside, respectively, in a state in which the tubular body of the hair holder is rolled up, side regions of the first surface sheet and side regions of the second surface sheet are joined to each other to for the sheet, thereby forming a pair of side joined regions in the tubular body, at least one of the side joined regions has a plurality of second-surface-sheet-side recesses along a longitudinal direction of the side joined region, and the second-surface-sheet-side recess is recessed from the second surface sheet side toward the first surface sheet side.

<2> The hair holder as set forth in clause <1>, wherein the second surface sheet constituting a bottom portion of the second-surface-sheet-side recess is situated on the first surface sheet side beyond a boundary between the second surface sheet and the first surface sheet where the second-surface-sheet-side recess is not present.

<3> The hair holder as set forth in clause <1> or <2>, wherein, in the second-surface-sheet-side recess, a region that occupies preferably 10% or greater, more preferably 30% or greater, even more preferably 50% or greater, and yet more preferably 100%, and further preferably from 10% to 100%, more preferably from 30% to 100%, even more preferably from 50% to 100%, and yet more preferably 100% of a thickness of the second surface sheet constituting a bottom portion of the second-surface-sheet-side recess is situated on the first surface sheet side beyond a boundary between the second surface sheet and the first surface sheet where the second-surface-sheet-side recess is not present.

<4> The hair holder as set forth in any one of clauses <1> to <3>, wherein the second-surface-sheet-side recess continuously extends over the entire width direction of the side joined region.

<5> The hair holder as set forth in any one of clauses <1> to <4>, wherein, in at least one of the side joined regions, in addition to the second-surface-sheet-side recesses being formed therein, a first-surface-sheet-side recess that is recessed from the first surface sheet side toward the second surface sheet side is also formed.

<6> The hair holder as set forth in clause <5>, wherein the side joined region has a plurality of the first-surface-sheet-side recesses along the longitudinal direction of the side joined region.

<7> The hair holder as set forth in clause <5> or <6>, wherein the first-surface-sheet-side recess has a shape that is complementary to a shape of the second-surface-sheet-side recesses.

<8> The hair holder as set forth in any one of clauses <5> to <7>, wherein the first surface sheet constituting a bottom portion of the first-surface-sheet-side recess is situated on the second surface sheet side beyond a boundary between the first surface sheet and the second surface sheet where the second-surface-sheet-side recess is not present.

<9> The hair holder as set forth in any one of clauses <5> to <8>, wherein, in the first-surface-sheet-side recess, a region that occupies preferably 10% or greater, more preferably 30% or greater, even more preferably 50% or greater, and yet more preferably 100%, and further preferably from 10% to 100%, more preferably from 30% to 100%, even more preferably from 50% to 100%, and yet more preferably 100% of a thickness of the first surface sheet constituting a bottom portion of the first-surface-sheet-side recess is situated on the second surface sheet side beyond a boundary between the first surface sheet and the second surface sheet where the second-surface-sheet-side recess is not present.

<10> The hair holder as set forth in any one of clauses <5> to <9>, wherein when a distance P1 between adjacent two of the second-surface-sheet-side recesses is taken as a reference, and a diameter of the hair holder in the state in which the tubular body is rolled-up at a position where the distance P1 between the adjacent two second-surface-sheet-side recesses is present is represented as D, a distance P2 between another adjacent two of the second-surface-sheet-side recesses located at a position that is shifted toward the first opening at the one end by a length of $\pi D$is preferably not less than 1.05 times, and more preferably not less than 1.1 times P1, and P2 is preferably not more than 5 times, and more preferably not more than 3 times P1, and further, P2 is preferably from 1.05 to 5 times, and more preferably from 1.1 to 3 times P1, and the side joined region also includes the first-surface-sheet-side recesses, and a distance P' between the first-surface-sheet-side recesses adjacent to each other along the longitudinal direction of the side joined region gradually increases from the second opening at the other end toward the first opening at the one end.

<11> The hair holder as set forth in any one of clauses <1> to <10>, wherein a distance between the second-surface-sheet-side recesses adjacent to each other along longitudinal direction of the side joined region gradually increases from the second opening at the other end toward the first opening at the one end.

<12> The hair holder as set forth in any one of clauses <1> to <11>, wherein the tubular body has a winding and tightening tab in the side joined region, the winding and tightening tab extending outward in a width direction.

<13> The hair holder as set forth in any one of clauses <1> to <12>, wherein the side joined region has a reinforcement portion.

<14> The hair holder as set forth in any one of clauses <1> to <13>, wherein a percentage of the sum total of areas of the second-surface-sheet-side recesses in an area of the side joined region is preferably 5% or greater, more preferably 10% or greater, and even more preferably 20% or greater, and preferably 70% or less, more preferably 60% or less, and even more preferably 55% or less, and the percentage of the sum total of areas of the second-surface-sheet-side recesses in an area of the side joined region is preferably from 5% to 70%, more preferably from 10% to 60%, and even more preferably from 20% to 55%.

<15> The hair holder as set forth in any one of clauses <1> to <14>, wherein a width of the second-surface-sheet-side recesses, that is, the length in the width direction is preferably 0.5 mm or greater, more preferably 0.8 mm or greater, and even more preferably 1 mm or greater, and the width of a second-surface-sheet-side recesses is preferably 5 mm or less, more preferably 4 mm or less, and even more preferably 3 mm or less, and the width of a second-surface-sheet-side recesses is preferably from 0.5 to 5 mm, more preferably from 0.8 to 4 mm, and even more preferably from 1 to 3 mm.

<16> The hair holder as set forth in any one of clauses <1> to <15>, wherein an area of the second-surface-sheet-side recess is preferably 0.19 $mm^2$ or greater, more preferably 0.50 $mm^2$ or greater, and even more preferably 0.78 $mm^2$ or greater, and the area of second-surface-sheet-side recess is preferably 25 $mm^2$ or less, more preferably 16 $mm^2$ or less, and even more preferably 9 $mm^2$ or less, and the area of second-surface-sheet-side recess is preferably from 0.19 to 25 $mm^2$, more preferably from 0.50 to 16 $mm^2$, and even more preferably from 0.78 to 9 $mm^2$.

<17> The hair holder as set forth in any one of clauses <1> to <16>, wherein the second-surface-sheet-side recess is formed in a part of the side joined region, and the part includes the second opening at the other end and occupies ⅓ or greater, or in particularly ½ or greater of the entire length of the side joined region.

<18> The hair holder as set forth in any one of clauses <1> to <17>, wherein the second-surface-sheet-side recess is formed over the entire side joined region.

<19> The hair holder as set forth in any one of clauses <1> to <18>, wherein, when a thickness of the side joined region is represented as t, and an apparent thickness thereof is represented as T, the value of T/t is from preferably 1.01 or greater, more preferably 1.1 or greater, and even more preferably 1.5 or greater, is preferably 20 or less, more preferably 10 or less, and even more preferably 5 or less, and is preferably from 1.01 to 20, more preferably from 1.1 to 10, and even more preferably from 1.5 to 5.

<20> The hair holder as set forth in any one of clauses <1> to <19>, wherein, when an apparent thickness of the side joined region is represented as T, the value of T is preferably 0.10 mm or greater, more preferably 0.20 mm or greater, and even more preferably 0.25 mm or greater, is preferably 2.00 mm or less, more preferably 1.50 mm or less, and even more preferably 1.00 mm or less, and is preferably from 0.10 to 2.00 mm, more preferably from 0.20 to 1.50 mm, and even more preferably from 0.25 to 1.00 mm.

<21> The hair holder as set forth in any one of clauses <1> to <20>, wherein the second-surface-sheet-side recess extends over the entire longitudinal direction of the side joined region and extends over the entire width direction of the side joined region.

<22> The hair holder as set forth in any one of clauses <1> to <21>, wherein, in addition to a distance P between the second-surface-sheet-side recesses adjacent to each other along the longitudinal direction of the side joined region gradually increasing from the second opening at the other end toward the first opening at the one end, a length L of the second-surface-sheet-side recess in the longitudinal direction gradually increases from the second opening at the other end toward the first opening at the one end.

<23> A method for manufacturing the hair holder as set forth in clause <1>, comprising:

in a state in which a first surface sheet and a second surface sheet oppose each other, joining side regions of the first surface sheet and side regions of the second surface sheet to each other, thereby forming a tubular body having a pair of side joined regions and, at the same time, forming a plurality of second-surface-sheet-side recesses in the side joined regions along a longitudinal direction of the side joined regions, the second-surface-sheet-side recesses being recessed from the second surface sheet side toward the first surface sheet side.

INDUSTRIAL APPLICABILITY

According to the present invention, a hair holder that is unlikely to slip when the hair holder is held and that easily bends and makes it easy to perform the rolling-up operation is provided.

The invention claimed is:

1. A hair holder comprising a tubular body and having a flat shape at least in a first state in which the tubular body is not rolled up, wherein the tubular body includes a sheet, and has a first opening located at a first end portion of the tubular body and a second opening located at a second end portion of the tubular body, and is configured to allow a bundle of hair to be inserted from the first opening toward the second opening, and the tubular body includes a first surface sheet and a second surface sheet that are located on the inside and the outside, respectively, in a second state in which the tubular body of the hair holder is rolled up, side regions of the first surface sheet and side regions of the second surface sheet are joined to each other to form the sheet, thereby forming a pair of side joined regions in the tubular body, at least one of the side joined regions has a plurality of second-surface-sheet-side recesses along a longitudinal direction of the side joined region, each of the second-surface-sheet-side recesses is recessed from the second surface sheet side toward the first surface sheet side, and wherein the second surface sheet constituting a bottom portion of the second-surface-sheet-side recess is situated on the first surface sheet side beyond a boundary between the second surface sheet and the first surface sheet where the second-surface-sheet-side recesses are not present.

2. The hair holder according to claim 1, wherein, in the second-surface-sheet-side recess, a region that occupies 10% or greater of a thickness of the second surface sheet constituting a bottom portion of the second-surface-sheet-side recess is situated on the first surface sheet side beyond a boundary between the second surface sheet and the first surface sheet where the second-surface-sheet-side recess is not present.

3. The hair holder according to claim 1, wherein the second-surface-sheet-side recess continuously extends over the entire width direction of the side joined region.

4. The hair holder according to claim 1, wherein, in at least one of the side joined regions, in addition to the second-surface-sheet-side recesses being formed therein, a first-surface-sheet-side recess that is recessed from the first surface sheet side toward the second surface sheet side is also formed.

5. The hair holder according to claim 4, wherein the side joined region has a plurality of the first-surface-sheet-side recesses along the longitudinal direction of the side joined region.

6. The hair holder according to claim 4, wherein the first-surface-sheet-side recess has a shape that is complementary to a shape of the second-surface-sheet-side recesses.

7. The hair holder according to claim 4, wherein the first surface sheet constituting a bottom portion of the first-surface-sheet-side recess is situated on the second surface sheet side beyond a boundary between the first surface sheet and the second surface sheet where the second-surface-sheet-side recess is not present.

8. The hair holder according to claim 1, wherein a distance between the second-surface-sheet-side recesses adjacent to each other along longitudinal direction of the side joined region gradually increases from the second opening at the other end toward the first opening at the one end.

9. The hair holder according to claim 1, wherein the tubular body has a winding and tightening tab in the side joined region, the winding and tightening tab extending outward in a width direction.

10. The hair holder according to claim 1, wherein the side joined region has a reinforcement portion.

11. The hair holder according to claim 1, wherein a percentage of the sum total of areas of the second-surface-sheet-side recesses in an area of the side joined region is from 5% to 70%.

12. The hair holder according to claim 1, wherein a width of the second-surface-sheet-side recess is from 0.5 to 5 mm.

13. The hair holder according to claim 1, wherein the second-surface-sheet-side recess is formed in a part of the side joined region, and the part includes the second opening at the other end and occupies ⅓ or greater of the entire length of the side joined region.

14. The hair holder according to claim 1, wherein the second-surface-sheet-side recesses are formed over the entire side joined region.

15. The hair holder according to claim 1, wherein, when a thickness of the side joined region is represented as t, and an apparent thickness thereof is represented as T, the value of T/t is from 1.01 to 20.

16. The hair holder according to claim 1, wherein, when an apparent thickness of the side joined region is represented as T, the value of T is from 0.10 to 2.00 mm.

17. The hair holder according to claim 1, wherein the second-surface-sheet-side recess extends over the entire longitudinal direction of the side joined region and extends over the entire width direction of the side joined region.

18. A method for manufacturing the hair holder according to claim 1, comprising:

in a state in which the first surface sheet and the second surface sheet oppose each other, joining the side regions of the first surface sheet and the side regions of the second surface sheet to each other, thereby forming the tubular body having the pair of side joined regions, and at the same time, forming the plurality of second-surface-sheet-side recesses in the side joined regions along the longitudinal direction of the side joined regions, the second-surface-sheet-side recesses being recessed from the second surface sheet side toward the first surface sheet side.

19. A hair holder comprising a tubular body and having a flat shape at least in a first state in which the tubular body is not rolled up, wherein the tubular body includes a sheet, and has a first opening located at a first end portion of the tubular body and a second opening located at a second end portion of the tubular body, and is configured to allow a bundle of hair to be inserted from the first opening toward the second opening, and the tubular body includes a first surface sheet and a second surface sheet that are located on the inside and the outside, respectively, in a second state in which the tubular body of the hair holder is rolled up, side regions of the first surface sheet and side regions of the second surface sheet are joined to each other to form the sheet, thereby forming a pair of side joined regions in the tubular body, at least one of the side joined regions has a plurality of second-surface-sheet-side recesses along a longitudinal direction of the side joined region, each of the second-surface-sheet-side recesses is recessed from the second surface sheet side toward the first surface sheet side, and wherein, in the second-surface-sheet-side recess, a region that occupies 10% or greater of a thickness of the second surface sheet constituting a bottom portion of the second-surface-sheet-side recess is situated on the first surface sheet side beyond a boundary between the second surface sheet and the first surface sheet where the second-surface-sheet-side recess is not present.

20. A hair holder comprising a tubular body and having a flat shape at least in a first state in which the tubular body is not rolled up, wherein the tubular body includes a sheet, and has a first opening located at a first end portion of the tubular body and a second opening located at a second end portion of the tubular body, and is configured to allow a bundle of hair to be inserted from the first opening toward the second opening, and the tubular body includes a first surface sheet and a second surface sheet that are located on the inside and the outside, respectively, in a second state in which the tubular body of the hair holder is rolled up, side regions of the first surface sheet and side regions of the second surface sheet are joined to each other to form the sheet, thereby forming a pair of side joined regions in the tubular body, at least one of the side joined regions has a plurality of second-surface-sheet-side recesses along a longitudinal direction of the side joined region, each of the second-surface-sheet-side recesses is recessed from the second surface sheet side toward the first surface sheet side, and wherein the second-surface-sheet-side recess extends over the entire longitudinal direction of the side joined region and extends over the entire width direction of the side joined region.

* * * * *